US005876889A

United States Patent [19]

Nakamura et al.

[11] Patent Number: 5,876,889

[45] Date of Patent: Mar. 2, 1999

[54] ELECTROPHOTOGRAPHIC PHOTOCONDUCTOR

[75] Inventors: Yoichi Nakamura; Kazumi Egota; Koji Kawaguchi; Yoshimasa Hattori, all of Kawasaki, Japan

[73] Assignee: Fuji Electric Co., Ltd., Kawasaki, Japan

[21] Appl. No.: 958,928

[22] Filed: Oct. 28, 1997

[30] Foreign Application Priority Data

Oct. 28, 1996 [JP] Japan ..... 8-285020

[51] Int. Cl.[6] ..... G06G 5/047; G06G 5/09

[52] U.S. Cl. ..... 430/58; 430/83; 430/96

[58] Field of Search ..... 430/58, 83, 96

[56] References Cited

U.S. PATENT DOCUMENTS 3,926,629 12/1975 Weigl ..... 430/76

5,639,849 6/1997 Hay ..... 430/96

OTHER PUBLICATIONS

Arthur W. Snow et al., "Syntheses and Characterization of Heteroatom–Bridged Metal–Free Phthalocyanine Network Polymers and Model Compounds" Macromolecules, pp. 1614–1624, 1984.

*Primary Examiner*—Roland Martin
*Attorney, Agent, or Firm*—Venable; Robert J. Frank

[57] ABSTRACT

An electrophotographic photoconductor has a conductive substrate and a photosensitive layer. The photosensitive layer is laminated on the conductive substrate and includes at least phthalocyanine compound as a photoconductive material. In the photosensitive layer, the content of o-phthalonitrile polymer except the phthalocyanine compound is in a range of 100 nmol to 200 mmol with respect to 1 mol of the phthalocyanine compound. Thus, the electrophotographic photoconductor has an excellent surface-charge retention.

7 Claims, 2 Drawing Sheets

ELECTROPHOTOGRAPHIC PHOTOCONDUCTOR

This application is based on patent application Ser. No. 8-285,020 filed Oct. 28, 1996 in Japan, the contents of which is incorporated hereinto by reference.

BACKGROUND OF THE INVENTION

1. Field of the Invention

The present invention relates to an electropthographic photoconductor to be used in a printer, a copying machine, a facsimile machine, and so on using the method of electrophotography. Especially, the present invention relates to an electrophotographic photoconductor having an excellent surface-charge retention by an improved photoconductive material for a photosensitive layer of the photoconductor.

2. Description of the Prior Art

In general, technical features required of electrophotographic photoconductors include abilities to hold surface charges in a dark place, to generate charges by receiving light, and to transport the charges by receiving light. The electrophotographic photoconductors can be grouped into two different types: one is a single layered type and the other is a so-called multiple layered type. The single layered type photoconductor has a single layer that combines the above abilities, while the multiple layered type one has function-separated laminated layers including a first layer responsible for generating charges and a second layer responsible for holding surface-charges in a dark place and for transporting charges at the time of receiving light.

Carlson process can be applied on an image formation based on the method of electrophotography using one of the above photoconductors. The Carlson process includes the steps of: uniformly charging the surface of the photoconductor in the absence of light by causing a corona discharge by airbreakdown; forming a latent image (a charge pattern on the photoconductor that mirrors the information to be transformed into the real image) of characters, figures, and the like of a source document; developing the latent image by adhering toner particles to the latent image by virtue of the electric field created by the charges on the photoconductor; transferring the developed toner particles on the photoconductor to paper by corona charging the back of the paper with a charge opposite to that of the toner particles and permanently fixing the image to the paper by melting the toner into the paper surface; and discharging and cleaning the photoconductor of any excess toner using coronas, lamps, brushes and/or scraper blades, recovering the photoconductor for reuse.

Heretofore, the following photoconductive materials have been used for the above electrophotographic photoconductors. The photoconductive materials include a compound prepared by dispersing an inorganic photoconductive material such as selenium, selenium alloy, zinc oxide, or cadmium sulfide into a resin binder and a compound prepared by dispersing an organic photoconductive material such as poly-N-vinyl carbazole, polyvinyl anthrancene, phthalocyanine compound, or bis-azo compound in a resin binder, or by the vacuum deposition instead of the dispersion.

The process of purifying the phthalocyanine compound as one of the above organic photoconductive materials has been studied in various ways in many references including A. W. Snow, et al., Macromorecules, 17 (8), 1614 (1984). These references describes 2, 4, 6-tris (2'-cyanophenyl)-1, 3, 5-triazine (hereinafter, it is abbreviated as triazine) which is a trimer as a polymerization product of o-phthalonitriles except a phthalocyanine compound (hereinafter, the product is abbreviated as a phthalonitrile polymer) in particular.

As described above, it is a known fact that the man skilled in the art uses the phthalocyanine compound as a photoconductive material of the electorophotographic photoconductor. In addition, the process for purificating the phthalocyanine compound has been also studied in various ways. In spite of those considerable works, by the way, some of the products of o-phthalocyanine polymerization may be defined as materials responsible for the electrophotographic properties of the electrophotoconductor. In this case, however, they have not been defined to a satisfactory degree under present circumstance. That is to say, the relationship between the materials associated with the process of preparing phthalocyanine compound and the electrophotographic properties, especially a surface-charge retention of photoconductor have not been defined well in spite of indicating the examples of various studies of phthalocyanine compound and various preparing processes for purifying the phthalocyanine compound.

SUMMARY OF THE INVENTION

An object of the present invention is to make the above relationship very clear to provide an electrophotographic photoconductor with excellent electrophotographic properties, especially an excellent surface-charge retention.

There is provided an electrophotographic photoconductor comprising a conductive substrate and a photosensitive layer, in which the photosensigtive layer is laminated on the conductive substrate and includes at least phthalocyanine compound as a photoconductive material, wherein the photosensitive layer contains o-phthalonitrile polymer, except the phthalocyanine compound, in a range of 100 nmol to 200 mmol with respect to 1 mol of the phthalocyanine compound.

Here, the phthalocyanine compound may be non-metallic phthalocyanine, preferably x-type non-metallic phthalocyanine.

The phthalocyanine compound may be titanyl oxyphthalocyanine, preferably a mixture of the titanyl oxyphthalocyanine and the o-phthalonitrile polymer except the titanyl oxyphthalocyanine having a clear peak of diffraction intensity observed at Bragg angle (2θ) of at least 27.3°±0.2° in an X-ray diffraction spectrum obtained by performing an X-ray diffraction method.

The phthalocyanine compound may be titanyl oxyphthalocyanine, preferably a mixture of the titanyl oxyphthalocyanine and the o-phthalonitrile polymer except the titanyl oxyphthalocyanine having a maximum diffraction intensity observed at Bragg angle (2θ±0.2°) of 9.6° and clear peaks of diffraction intensity observed at 7.2°, 9.6°, 11.6°, 13.4°, 14.9°, 18.3°, 23.6°, 24.1°, and 27.3°, respectively, in an X-ray diffraction spectrum.

A center metal of the phthalocyanine compound may be selected from a group of zirconium, vanadium, niobium, gallium, indium, germanium, and tin.

An under coat layer may be provided between the conductive substrate and the photosensitive layer.

The photosensitive layer may comprise a charge generation layer and a charge transport layer laminated on the charge generation layer, and the phthalocyanine compound may included in the charge generation layer.

The above and other objects, effects, features and advantages of the present invention will become apparent from the following description of embodiments thereof taken in conjunction with the accompanying drawings.

DETAILED DESCRIPTION OF THE PREFERRED EMBODIMENTS

Hereinafter, an electrophotographic photoconductor of the present invention will be described in a concretive manner with reference to FIG. 1.

There are three types of electrophotographic photoconductor. That is, a negative-charged laminated type, a positive-charged laminated type, and a positive-charged single-layered type. In the following description, but not limited to, the negative-charged laminated type photoconductor will be used as an example of the present invention. Ingredients, methods, and the like for the manufacturing or preparing process of the photoconductor except those associated with phthalonitrile polymer may be appropriately selected from well-known ingredients, method, and the like as necessary.

Figure 1:
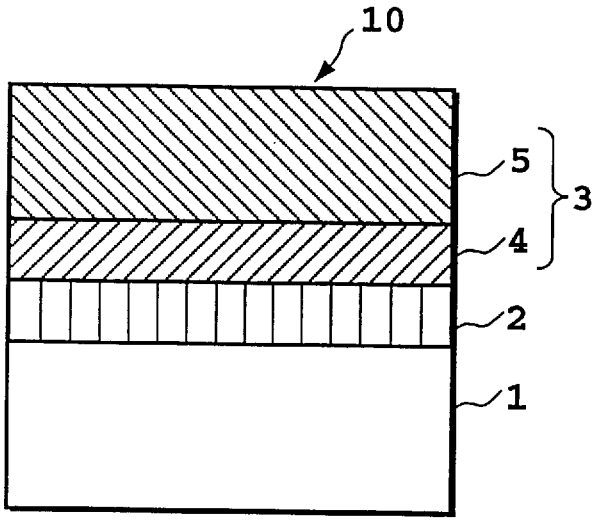
FIG. 1 is a cross sectional view of an electrophotographic photoconductor as one of the embodiments of the present invention.

As shown in FIG. 1, an electrophotographic photoconductor 10 is in the type of having a negatively-charged laminated structure and comprises a conductive substrate 1, an under coat layer 2, and a photosensitive layer 3. As shown in the figure, the layers 2 and 3 are laminated on the conductive substrate 1 in that order. In this case, the photosensitive layer 3 is provided as a functionally distinguished type layer having a charge generation layer 4 and a charge transport layer 5 (the latter is formed on the former).

The conductive substrate 1 is not only provided as an electrode of the photoconductor but also provided as a supporting member that supports each of the above laminated layers. The conductive substrate 1 may be in the shape of cylinder, board, film, or the like made of a metal material such as aluminum, stainless steel, or nickel, or an electrical insulating material such as a glass material or a resin on which a conductive material is applied.

The under coat layer 2 may be selected from the group of alcohol-soluble polyamides, solvent-soluble aromatic polyamides, thermoset urethane resins, and the like. The alcohol-soluble polyamides include copolymerized compounds such as nylon-6, nylon-8, nylon-12, nylon-66, nylon-610, and nylon-612, and N-alkyl denatured or N-alkoxy alkyl denatured nylon. Concrete exemplified compounds are commercially available, such as AMILAN CM-8000 (Toray Co., Ltd., 6/66/610/12 copolymerized nylon), ELBAMIDE 9061 (DuPont Japan Co., Ltd., 6/66/612 copolymerized nylon), and DIAMIDE T-170 (DAICEL-HÜLZ Co., Ltd., nylon 12 based copolymerized nylon).

Furthermore, inorganic powders of $TiO_2$, alumina, calcium carbonate, silica, or the like may be additionaly comprised in the composition of the under coat layer 2.

The charge generation layer 4 is responsible for generating charges by receiving light. The layer 4 may be formed by performing a vacuum deposition of the organic photoconductive material or a coating of the material prepared by dispersing the powder of organic photoconductive material into a resin binder. The important features of the charge generation layer 4 include a high efficiency of charge generation and an ability of injecting the generated charges into the charge transport layer. It is preferable that the charge generation layer has a little dependence on the electric field and the injection is excellently performed whatever under lower electric field.

In the present invented charge generation layer, it is necessary to include at least phthalocyanine compound as a charge generation material. In combination therewith or individually, another charge generation material such as one selected from the group of pigments or dyes such as various kinds of azo, quinone, indigo, cyanine, squalene, and azulene compounds may be included. In the present invented charge generation layer, furthermore, the content of the phthalonitrile polymer is in the range of 100 nmol to 200 mmol, preferably of 200 nmol to 10 mmol per 1 mol of the phthalocyanine compound, resulting in a heavy increase of the surface-charge retention. The functional mechanism of the increase has not been cleared perfectly, but the following consideration may be adapted.

A drop in surface-charge retention may be caused by the degradation of the dispersion properties of phthalocyanine compound or by the excess growth of its crystal as a result of over purification of the phthalocyanine compound if the content of the phtalonitrile polymer is less than 100 nmol. On the other hand, if the content exceeds 200 mmol, the drop in surface-charge retention may also be caused by over irregular crystal arrangement of the phthalocyanine compound or by the effects of the phthalonitrile polymer itself.

A well-known method of preparing phthalocyanine compound may be used in the present invention, such as the one disclosed in "The Phthalocyanines, F. H. Moser, et al., 1983 (CRC Press)" or the like.

The phthalocyanine compound may be of having the improved electrophotographic properties including sensitivities and residual potentials. Preferably, it is a non-metallic phthalocyanine, and more preferably it is an X-type non-metallic phthalocyanine.

Figure 2:
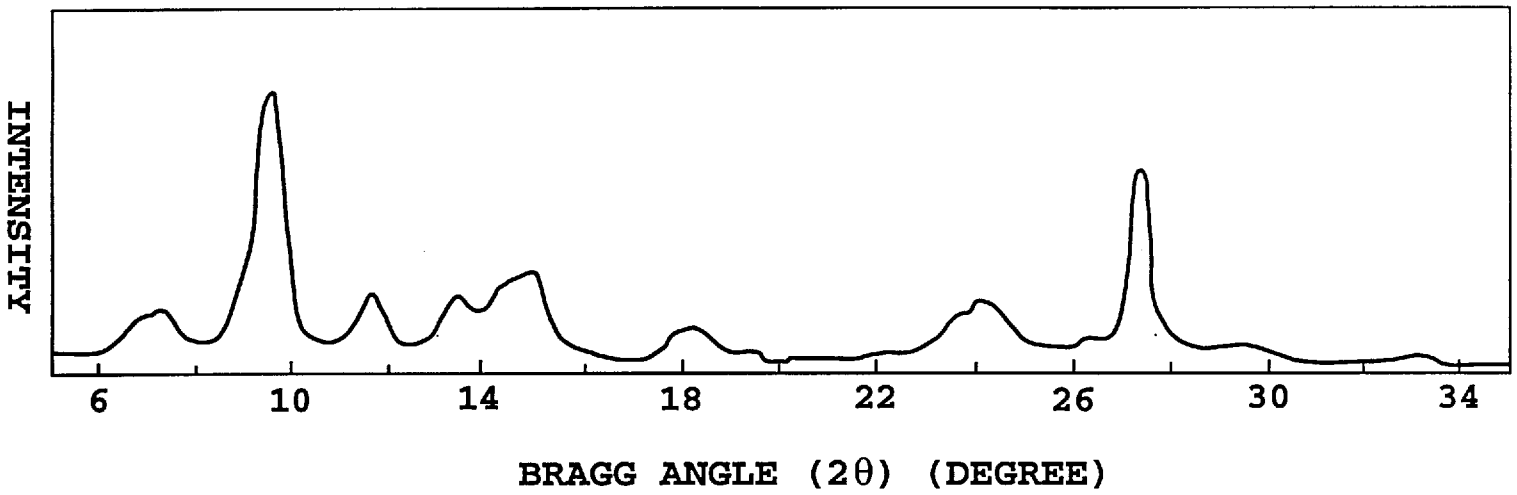
FIG. 2 is an X-ray diffraction spectrum pattern of titanyloxyphthalocyanine crystal to be applied in the electrophotographic photoconductor.

From the point of spectral sensitivity, it is preferable to use titanyloxyphthalocyanine as a phtalocyanine. More preferably, a mixture of the titanyloxyphathalocianine and the phthalonitrile polymer has the maximum diffraction intensity observed at Bragg angle (2θ±0.2°) of 9.6° and clear peaks of diffraction intensity observed at 7.20°, 9.6°, 11.6°, 13.4°, 14.9°, 18.3°, 23.6°, 24.1°, and 27.3°, respectively, in an X-ray diffraction spectrum obtained by performing an X-ray diffraction method. This spectrum pattern has something in common with the X-ray diffraction spectrum pattern of titanyloxyphthalocyanine crystal disclosed in U.S. patent application Ser. No. 08/645,322, 1995 filed May 13, 1996 which is a continuation application of U. S. patent application Ser. No. 08/562,348 filed Nov. 22, 1995. The whole description of this Continuation Applicaiton is incorporated herein as a part of the description of the present invention. The X-ray diffraction spectrum pattern of titanyloxyphthalocyanine crystal of the above reference is shown in FIG. 2. As shown in the figure, the clear peaks of diffraction intensity are observed at 7.22°±0.2°, 9.60°±0.2°, 11.60°±0.2°, 13.40°±0.2°, 14.88°±0.2°, 18.34°±0.2°, 23.62°±0.2°, 24.14°±0.2°, and 27.32°±0.2°, respectively. Furthermore, a result of the structural analysis using X-ray indicates that the titanyloxyphthalocyanine crystal described above is classified as a triclinic crystal having a lattice constant of:

a=16.3058 Å, b=23.078 Å, c=8.7155 Å,

α=101.352°, β=23.078°, and γ=117.530°, with an allowable error of ±1%.

A structure of the titanyloxyphthalocyanine in accordance with the present invention is represented by the general formula (I) below.

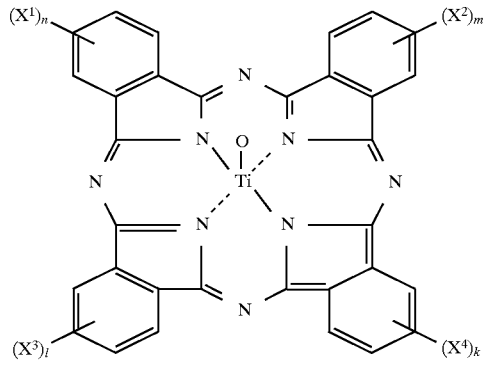

(I)

wherein $X^1$, $X^2$, $X^3$, and $X^4$ stand for Cl or Br, n, m, l, and k stand for one of integral numbers from 0 to 4.

In the present invention, furthermore, a central metal of the above phthalocyanine compound may be selected from the group of zirconium, vanadium, niobium, gallium, indium, germanium, and tin. Each of the phthalocyanine compounds is selected considering compatibility with charge transport material in the charge transport layer with respect to charge injection characteristics of the phthalicyanine compound in a charge generation layer into the charge transport layer.

Various kinds of phthalonitrile polymers may be applied in the present invention. The phthalonitrile polymers include 3-mers, 5-mers, 7-mers, 9-mers, 11-mers, and so on. The 3-mer can be prepared by the method described in the reference mentioned above. A mass spectrometric analysis reveals that those polymers including the 3-mer are generated as by-products at the time of preparing the phthalocyanine compound. The by-products can be dissolved in cyclohexane, so that the by-product can be removed by a sublimation process or a cyclohexane purification method. Furthermore, phthalonitrile polymer generated as a by-product at the time of the synthesis may be used without any modification.

The charge transport layer 5 is laminated on the charge generation layer 4, so that a thickness of the charge generation layer 4 is determined by a light absorption coefficient of the charge generation material. In general, it is 5 μm or less, preferably 1 μm or less. The charge generation layer 4 may be also used mainly including the charge generation material with additional charge transport material and other material.

The resin binder of the charge generation layer may be selected from the group of hydrophobic high-molecular polymers or co-polymers that form high electrical insulating films. To put it more concretely, the binder is one or a mixture of one or more selected from the compounds including phenol resin, polyester resin, vinyl acetate resin, polycarbonate resins, polypeptide resins, cellulose resins, polyvinyl pyrolidone, polyethylene oxide, polyvinyl chloride resin, polyvinylidene chloride resin, polystyrene resin, polyvinyl acetate, styrene-butadiene copolymer, vinylidene chloride-acrylonitrile copolymer, vinyl chloride-vinyl acetate copolymer, vinyl chloride-vinyl acetate-maleic anhydride copolymer, silicon-alkyd resin, phenol-formaldehyde resin, styrene-alkyd resin, polyvinyl alcohol, acrylic copolymer resin, methacryl copolymer resin, silicone resin, methacrylonitrile copolymer resin, polyvinyl butyral, polyvinylidene chloride resin, and the like. In general, the content of the charge generation material is 10 to 5000 parts by weight, preferably 50 to 1000 parts by weight with respect to 100 parts by weight of the resin binder.

The charge transport layer 5 is a coating film made of a material prepared by dispersing various kinds of hydrazone compounds, styryl compounds, amine compounds, and their derivatives or mixtures thereof. The charge transport layer 5 is provided as an insulation film to hold charges in the photosensitive layer in a dark place, and also it is provided as one having an ability to transport charges to be injected from the charge generation layer at the time of receiving light. The binder resin for the charge transport layer may be selected from polycarbonate, polyester, polystyrene, and metacrylate ester polymers and copolymers. In this case, however, it is very important to select the compound in consideration of mechanical, chemical, and physical stabilities, contactivity, and compatibility with the charge transport material. The content of the charge transport material is 20 to 500 parts by weight, preferably 30 to 300 parts by weight with respect to 100 parts of the resin binder. A thickness of the charge transport layer may be 3 to 50 μm, preferably, and more preferably 15 to 40 μm.

EXAMPLES

We are now explaining the concrete examples in accordance with the present invention, but the present invention cannot be limited to those examples.

Examples 1 to 10 and Comparative Examples 1 to 4

Example 1

The Process for Preparing an Under Coat Layer

An under coat layer was prepared by the process including the steps of preparing a coating liquid of under-coating layer by mixing 70 parts by weight of polyamide resin (AMILAN CM8000, supplied by Toray Co., Ltd.) with 930 parts by weight of methanol (Wako Pure Chemical Industries Co., Ltd.) and coating the under-coating liquid on an aluminum substrate by using a dip-coating method, resulting in the under coat layer of 0.5 μm in thickness after drying.

The Process for Preparing a Charge Generation Layer

The non-metallic phthalocyanine prepared by the reference described above was purified by cyclohexane (Wako Pure Chemical Industries Co., Ltd.) and then it was purified by vacuum sublimation, followed by second purification by cyclohexan, and finally it is dried. Triazine prepared according to the reference was added to the non-metallic phthalocyanine at the ratio of 100 nmol of the former to 1 mol of the latter. The obtained compound was further progressed in the ball mill method to change the non-metallic phthalocyanine into the X-typed one according to the reference. Then a mixture was prepared by blending 10 parts by weight of the X-type non-metallic phthalocyanine, 10 parts by weight of a vinyl chloride resin (MR-110, NIPPON ZEON Co., Ltd.), 686 parts by weight of dichloromethane (Wako Pure Chemical Industries Co., Ltd.), and 294 parts by weight of 1, 2-dichloroethane (Wako Pure Chemical Industries Co., Ltd.). The mixture was further subjected to an ultrasonic dispersion to prepare a solution for forming a charge generation layer. Then the solution was dip-coated on the under coat layer to form a charge generation layer with a thickness of 0.2 μm after drying.

Forming a Charge Transport Layer

A coating liquid for the charge transport layer was prepared by mixing 100 parts by weight of 4-(diphenylamino) benzaldehyde phenyl (2-thienylmethyl) hydrazone (provided as a trial compound), 100 parts by weight of polycarbonate (PANLITE K-1300, Teijin Chemicals Co., Ltd.), 800 parts by weight of dichloromethane, and 1 parts by weight of silane coupling agent (KP-340, Shinetsu Chemicals Co., Ltd.), together. Then the obtained coating liquid was applied on the charge generation layer by using a dip-coating method. After drying, the charge transport layer of 20 μm in thickness was formed, resulting in a photoconductor as a final product.

Example 2

A photoconductor was prepared by the same way as that of Example 1 except that the content of triazine was changed to 10 μmol per 1 mol of non-metallic phthalocyanine.

Example 3

A photoconductor was prepared by the same way as that of Example 1 except that the content of triazine was changed to 1 mmol per 1 mol of non-metallic phthalocyanine.

Example 4

A photoconductor was prepared by the same way as that of Example 1 except that the content of triazine was changed to 100 mmol per 1 mol of non-metallic phthalocyanine.

Example 5

A photoconductor was prepared by the same way as that of Example 1 except that the content of triazine was changed to 200 mmol per 1 mol of non-metallic phthalocyanine.

Example 6

A photoconductor was prepared by the same way as that of Example 1 except that an acid pasting treatment is performed in Example 6 using concentrated sulfuric acid (manufactured by Kanto Kagaku Kogyo Co., Ltd.) after adding triazine, followed by washing in water, and drying.

Example 7

A photoconductor was prepared by the same way as that of Example 6 except that the content of triazine was changed to 10 μmol per 1 mol of non-metallic phthalocyanine.

Example 8

A photoconductor was prepared by the same way as that of Example 6 except that the content of triazine was changed to 1 mmol per 1 mol of non-metallic phthalocyanine.

Example 9

A photoconductor was prepared by the same way as that of Example 6 except that the content of triazine was changed to 100 mmol per 1 mol of non-metallic phthalocyanine.

Example 10

A photoconductor was prepared by the same way as that of Example 6 except that the content of triazine was changed to 200 mmol per 1 mol of non-metallic phthalocyanine.

Comparative Example 1

A photoconductor was prepared by the same way as that of Example 1 except that the content of triazine was changed to 50 nmol per 1 mol of non-metallic phthalocyanine.

Comparative Example 2

A photoconductor was prepared by the same way as that of Example 1 except that the content of triazine was changed to 300 mmol per 1 mol of non-metallic phthalocyanine.

Comparative Example 3

A photoconductor was prepared by the same way as that of Example 6 except that the content of triazine was changed to 50 nmol per 1 mol of non-metallic phthalocyanine.

Comparative Example 4

A photoconductor was prepared by the same way as that of Example 6 except that the content of triazine was changed to 300 mmol per 1 mol of non-metallic phthalocyanine.

The electrical characteristics of thus obtained photoconductors, Examples 1 to 9 and Comparative Examples 1 to 4 were estimated by using an electrostatic recording paper testing device EPA-8100 manufactured by Kawaguchi Electric Works Co., Ltd.

A surface of the photoconductor was charged by a corona discharge of a corotron system in darkness. In this case, a discharge voltage was regulated so as to charge the photoconductor's surface at a charged potential of −600 v. Then the corona discharge was switched off and the photoconductor was further placed in darkness for 5 seconds. During this period, the surface charge retention (%) was measured and listed in Table 1.

TABLE 1

| Examples (Ex.) or Comparative Examples (Com.) | Surface charge retention (%) |
|---|---|
| Ex. 1 | 97.3 |
| Ex. 2 | 96.1 |
| Ex. 3 | 96.9 |
| Ex. 4 | 96.2 |
| Ex. 5 | 97.1 |
| Ex. 6 | 96.9 |
| Ex. 7 | 96.4 |
| Ex. 8 | 96.1 |
| Ex. 9 | 97.4 |
| Ex. 10 | 97.2 |
| Com. 1 | 90.3 |
| Com. 2 | 88.1 |
| Com. 3 | 90.7 |
| Com. 4 | 89.5 |

As shown in Table 1, each of the photoconductors of Examples 1 to 10 shows excellent surface charge retention. On the other hand, the surface charge retention of each of Comparative Examples 1 to 4 is lower than that of Examples.

Examples 11 to 20 and Comparative Examples 5 to 8

Example 11

Forming an Under Coat Layer

An under coat layer was prepared by the process including the steps of preparing a coating liquid of under-coating layer by mixing 70 parts by weight of polyamide resin (AMIRAN Toray Co., Ltd.) with 930 part of methanol (Wako Pure Chemical Industries Co., Ltd.) and coating the under-coating liquid on an aluminum substrate by using a dip-coating method, resulting in the under coat layer of 0.5 μm in thickness after drying.

Forming a Charge Generation Layer 800 g of o-phthalodinitrile (Tokyo Kasei Kogyo Co., Ltd.) was mixed with 1,8 liters of quinoline (Kanto Kagaku Co., Ltd.) in a reactor with stirring. Then, 297 g of titanium tetrachloride (Kishida Kagaku Co., Ltd.) was dropped into the mixture with stirring under a nitrogen atmosphere. After the dropping, the mixture was further stirred under the condition of heating at 180° C. for 15 hours.

The reaction mixture was naturally cooled to 130° C. and then filtered. The obtained precipitation was washed with 3 liters of N-methyl-2-pyrrolidinon (Kanto Kagaku Co., Ltd.). Under a nitrogen atmosphere, a wet cake was suspended in 1.8 liters of N-methyl-2-pyrrolidinon with stirring at 160° C. for 1 hour. Then, the mixture was cooled and filtered. The obtained precipitation was washed with 3 liters of N-methyl-2-pyrrolidinon, 2 liters of acetone (Kanto Kagaku Co., Ltd.), 2 liter of methanol (Kanto Kagau Co., Ltd.), and 4 liters of warm water in that order. A wet cake of titanyloxyphthalocyanine thus obtained was further suspended in a diluted hydrochloric acid provided as a mixture of 4 liters of water and 360 ml of 36% hidrochloric acid and heated with stirring at 80° C. for 1 hour. Then, the mixture was cooled, filtered, washed with 4 liters of warm water, and dried.

The mixture was purified by using cyclohexane (Wako Pure Chemical Industries Co., Ltd.) and then further purified by means of vacuum sublimation, followed by drying an obtained product after re-purifying the product by a cyclohexane.

200 g of the dried product was added into 4 kg of 96% sulfuric acid (Kanto Kagaku Co., Ltd.) being cooled to −5° C. or below with stirring. Then the mixture was kept at −5° C. for 1 hour with stirring. After that, the resulting solution of sulfuric acid was added into 35 liters of water with 5 kg of ice with stirring for 1 hour so as to keep it at the temperature of 10° C. or below. The resulting solution was filtered and washed by 10 liter of warm water.

Furthermore, the precipitation was suspended in the mixture of 10 liters of water and 770 ml of 36% hydrochloric acid with stirring at 80° C. for 1 hour. Then, the resulting solution was cooled and filtered. After washing with 10 liters of warm water, the resulting product was dried.

Then, 100 nmol of triazine per 1 mol of titanyloxyphthalocyanine was added to the resulting product.

The resulting product, 0.5 liters of water, and 1.5 ml of o-dichlorobenzene (Kanto Kagaku Co., Ltd.) were placed in a ball milling apparatus with 6.6 kg of zirconia balls having 8 mm in diameter to perform 24 hour milling. After the milling, 1.5 liters of acetone and 1.5 liters of methanol were used for recovering the resulting product. The recovered product was filtered and then washed with 1.5 liters of water, followed by drying.

The titanyloxyphthalocyanine compound containing triazine was subjected to an X-ray diffraction system (MacScience, MXP18VA) and its X-ray diffraction spectrum was measured. Consequently, at least, clear peaks of diffraction intensity were observed at Bragg angle (2θ±0.2°) of 7.2°, 9.6°, 11.6°, 13.4°, 14.9°, 18.3°, 23.6°, 24.1°, and 27.3° (the maximum at 9.6°), respectively, in an X-ray diffraction spectrum obtained by performing an X-ray diffraction method.

10 parts by weight of titanyloxyphthalocyanine compound containing triazine, 10 parts by weight of vinyl chloride resin (MR-101, Nippon Zeon Co., Ltd.), 686 parts by weight of dichloromethane, and 294 parts by weight of 1, 2-dichloroethane were mixed and ultrasonically dispersed to prepare a coating liquid of charge generation layer. The resulting coating liquid was applied on a surface of the under coat layer by dip-coating. Consequently, the charge generation layer with 0.2 μm in thickness was obtained after drying.

Forming a Charge Transport Layer

A coating liquid for the charge transport layer was prepared by mixing 100 parts by weight of 4-(diphenylamino) benzaldehyde phenyl (2-thienylmethyl) hydrazone (provided as a trial compound), 100 parts by weight of polycarbonate (PANLITE, Teijin Chemicals Co., Ltd.), 800 parts by weight of dichloromethane, and 1 parts by weight of silane coupling agent (KP-340, Shinetsu Chemicals Co., Ltd.), together. Then the obtained coating liquid was applied on the charge generation layer by using a dip-coating method. After drying, the charge transport layer of 20 μm in thickness was formed, resulting in a photoconductor as a final product.

Example 12

A photoconductor was prepared by the same way as that of Example 11 except that the content of triazine was changed to 10 μmol per 1 mol of tytanyloxyphthalocyanine.

Example 13

A photoconductor was prepared by the same way as that of Example 11 except that the content of triazine was changed to 1 mmol per 1 mol of tytanyloxyphthalocyanine.

Example 14

A photoconductor was prepared by the same way as that of Example 11 except that the content of triazine was changed to 100 mmol per 1 mol of tytanyloxyphthalocyanine.

Example 15

A photoconductor was prepared by the same way as that of Example 1 except that the content of triazine was changed to 200 mmol per 1 mol of tytanyloxyphthalocyanine.

Example 16

Forming an Under Coat Layer

An under coat layer was prepared by the process including the steps of preparing a coating liquid of under-coating layer by mixing 70 parts by weight of polyamide resin (AMILAN CM-8000, supplied by Toray Co., Ltd.) with 930 part of methanol (Wako Pure Chemical Industries Co., Ltd.) and coating the under-coating liquid on an aluminum substrate by using a dip-coating method, resulting in the under coat layer of 0.5 μm in thickness after drying.

Forming a charge generation layer 800 g of o-phthalodinitrile (Tokyo Kasei Kogyo Co., Ltd.) was mixed with 1,8 liters of quinoline (Kanto Kagaku Co., Ltd.) in a reactor with stirring. Then, 297 g of titanium tetrachloride (Kishida Kagaku Co., Ltd.) was dropped into the mixture with stirring under a nitrogen atmosphere. After the dropping, the mixture was further stirred under the condition of heating at 180° C. for 15 hours.

The reaction mixture was naturally cooled to 130° C. and then filtered. The obtained precipitation was washed with 3 liters of N-methyl-2-pyrrolidinone (Kanto Kagaku Co., Ltd.). Under a nitrogen atmosphere, a wet cake was suspended in 1.8 liters of N-methyl-2-pyrrolidinon with stirring at 160° C. for 1 hour. Then, the mixture was cooled and filtered. The obtained precipitation was washed with 3 liters of N-methyl-2-pyrrolidinone, 2 liters of acetone (Kanto Kagaku Co., Ltd.), 2 liters of methanol (Kanto Kagaku Co., Ltd.), and 4 liters of warm water in that order. A wet cake of titanyloxyphthalocyanine thus obtained was further suspended in a diluted hydrochloric acid provided as a mixture of 4 liters of water and 360 ml of 36% hidrochloric acid and heated with stirring at 80° C. for 1 hour. Then, the mixture was cooled, filtered, washed with 4 liters of warm water, and dried.

The mixture was purified by using cyclohexane (Wako Pure Chemical Industries Co., Ltd.) and then further purified by means of vacuum sublimation, followed by drying an obtained product after re-purifying the product by a cyclohexane.

Then, 100 nmol of triazine per 1 mol of titanyloxyphthalocyanine was added to the resulting product.

200 g of the dried product with triazine was added into 4 kg of 96% sulfuric acid (Kanto Kagaku Co., Ltd.) being cooled to −5° C. or below with stirring. Then the mixture was kept at −5° C. for 1 hour with stirring. After that, the resulting solution of sulfuric acid was added into 35 liters of water with 5 kg of ice with stirring for 1 hour so as to keep it at the temperature of 10° C. or below. The resulting solution was filtered and washed by 10 liters of warm water.

Furthermore, the precipitation was suspended in the mixture of 10 liters of water and 770 ml of 36% hydrochloric acid with stirring at 80° C. for 1 hour. Then, the resulting solution was cooled and filtered. After washing with 10 liters of warm water, the resulting product was dried.

The resulting product, 0.5 liters of water, and 1.5 liters of o-dichlorobenzene (Kanto Kagaku Co., Ltd.) were placed in a ball milling apparatus with 6.6 kg of zirconia balls having 8 mm in diameter to perform 24 hour milling. After the milling, 1.5 liters of acetone and 1.5 liters of methanol were used for recovering the resulting product. The recovered product was filtered and then washed with 1.5 liters of water, followed by drying.

A titanyloxyphthalocyanine compound containing triazine was subjected to an X-ray diffraction system (MacScience, MXP18VA) and its X-ray diffraction spectrum was measured. Consequently, at least, clear peaks of diffraction intensity was observed at Bragg angle (2θ±0.2°) of 7.2°, 9.6°, 11.6°, 13.4°, 14.9°, 18.3°, 23.6°, 24.1°, and 27.3° (the maximum at 9.6°), respectively, with in an X-ray diffraction spectrum obtained by performing an X-ray diffraction method.

10 parts by weight of titanyloxyphthalocyanine compound containing triazine, 10 parts by weight of vinyl chloride resin (MR-110, Nippon Zeon Co., Ltd.), 686 parts by weight of dichloromethane, and 294 parts by weight of 1, 2-dichloroethane were mixed and ultrasonically dispersed to prepare a coating liquid of charge generation layer. The resulting coating liquid was applied on a surface of the under coat layer by dip-coating. Consequently, the charge generation layer with 0.2 μm in thickness was obtained after drying.

Forming a Change Transport Layer

A coating liquid for the charge transport layer was prepared by mixing 100 parts by weight of 4-(diphenylamino) benzaldehyde phenyl (2-thienylmethyl) hydrazone (provided as a trial compound), 100 parts by weight of polycarbonate (PANLITE, Teijin Chemicals Co., Ltd.), 800 parts by weight of dichloromethane, and 1 parts by weight of silane coupling agent (Shinetsu Kagaku Kogyo, KP-340), together. Then the obtained coating liquid was applied on the charge generation layer by using a dip-coating method. After drying, the charge transport layer of 20 μm in thickness was formed, resulting in a photoconductor as a final product.

Example 17

A photoconductor was prepared by the same way as that of Example 16 except that the content of triazine was changed to 10 μmol per 1 mol of tytanyloxyphthalocyanine.

Example 18

A photoconductor was prepared by the same way as that of Example 16 except that the content of triazine was changed to 1 mmol per 1 mol of tytanyloxyphthalocyanine.

Example 19

A photoconductor was prepared by the same way as that of Example 16 except that the content of triazine was changed to 100 mmol per 1 mol of tytanyloxyphthalocyanine.

Example 20

A photoconductor was prepared by the same way as that of Example 16 except that the content of triazine was changed to 200 mmol per 1 mol of tytanyloxyphthalocyanine.

Comparative Example 5

A photoconductor was prepared by the same way as that of Example 11 except that the content of triazine was changed to 50 nmol per 1 mol of tytanyloxyphthalocyanine.

Comparative Example 6

A photoconductor was prepared by the same way as that of Example 11 except that the content of triazine was changed to 300 mmol per 1 mol of tytanyloxyphthalocyanine.

Comparative Example 7

A photoconductor was prepared by the same way as that of Example 16 except that the content of triazine was changed to 50 nmol per 1 mol of tytanyloxyphthalocyanine.

Comparative Example 8

A photoconductor was prepared by the same way as that of Example 16 except that the content of triazine was changed to 300 mmol per 1 mol of tytanyloxyphthalocyanine.

The electrical characteristics of photoconductors were estimated by using an electrostatic recording paper testing device EPA-8100 manufactured by Kawaguchi Electric Works Co., Ltd.

A surface of the photoconductor was charged by a corona discharge of a corotron system in darkness. In this case, a discharge voltage was regulated so as to charge the photoconductor's surface at a charged potential of −600 V. Then the corona discharge was switched off and the photoconductor was further placed in darkness for 5 seconds. During this period, the surface charge retention (%) was measured and listed in Table 2.

TABLE 2

| Examples (Ex.) or Comparative Examples (Com.) | Surface charge retention (%) |
|---|---|
| Ex. 11 | 98.1 |
| Ex. 12 | 97.0 |
| Ex. 13 | 97.7 |
| Ex. 14 | 97.6 |
| Ex. 15 | 97.3 |
| Ex. 16 | 97.8 |
| Ex. 17 | 97.7 |
| Ex. 18 | 97.2 |
| Ex. 19 | 97.6 |
| Ex. 20 | 98.0 |
| Com. 5 | 91.1 |
| Com. 6 | 89.5 |
| Com. 7 | 91.4 |
| Com. 8 | 89.9 |

As shown in Table 2, each of the photoconductors of Examples 11 to 20 shows excellent surface charge retention. On the other hand, the surface charge retention of each of Comparative Examples 5 to 8 is lower than that of Examples.

Examples 21 to 30 and Comparative Examples 9 to 12

Example 21

Forming an Under Coat Layer 70 parts by weight of a polyamide resin (AMILAN CM-8000, Toray Co., Ltd.) was mixed with 930 parts by weight of methanol (Wako Pure Chemical Industries Co., Ltd.) to obtain a coating liquid. The obtained liquid was applied on an aluminum substrate by dip-coating, resulting in an under coart layer with a thickness of 0.5 μm after drying.

Forming a Charge Generation Layer

Zirconium phthalocyanine prepared by the conventional method was purified using cyclohexane. After that, the zirconium phthalocyanine was further purified by a vacuum sublimation and then by cyclohexane. The purified compound wad dried.

Triazine was added to the purified zirconium phthalocyanine at a ratio of 100 nmol to 1 mol.

10 parts by weight of zirconium phthalocyanine compound containing triazine, 10 parts by weight of vinyl chloride resin (MR-110, Nippon Zeon Co., Ltd.), 686 parts by weight of dichloromethane, and 294 parts by weight of 1, 2-dichloroethane were mixed and ultrasonically dispersed to prepare a coating liquid of charge generation layer. The resulting coating liquid was applied on a surface of the under coat layer by dip-coating. Consequently, the charge generation layer with 0.2 μm in thickness was obtained after drying.

Forming a Change Transport Layer

A coating liquid for the charge transport layer was prepared by mixing 100 parts by weight of 4-(diphenylamino) benzaldehyde phenyl (2-thienylmethyl) hydrazone (provided as a trial compound), 100 parts by weight of polycarbonate (PANLITE K-1300, Teijin Chemicals K-1300), 800 parts by weight of dichloromethane, and 1 parts by weight of silane coupling agent (KP-340, Shinetsu Kagaku Kogyo Co., Ltd.), together. Then the obtained coating liquid was applied on the charge generation layer by using a dip-coating method. After drying, the charge transport layer of 20 μm in thickness was formed, resulting in a photoconductor as a final product.

Example 22

A photoconductor was prepared by the same way as that of Example 21 except that the content of triazine was changed to 10 μmol per 1 mol of zirconium phthalocyanine.

Example 23

A photoconductor was prepared by the same way as that of Example 21 except that the content of triazine was changed to 1 mmol per 1 mol of zirconium phthalocyanine.

Example 24

A photoconductor was prepared by the same way as that of Example 21 except that the content of triazine was changed to 100 mmol per 1 mol of zirconium phthalocyanine.

Example 25

A photoconductor was prepared by the same way as that of Example 21 except that the content of triazine was changed to 200 mmol per 1 mol of zirconium phthalocyanine.

Example 26

A photoconductor was prepared by the same way as that of Example 21 except that an acid pasting treatment using 96% sulfuric acid was performed after adding triazine, followed by washing in water and drying.

Example 27

A photoconductor was prepared by the same way as that of Example 26 except that the content of triazine was changed to 10 μmol per 1 mol of zirconium phthalocyanine.

Example 28

A photoconductor was prepared by the same way as that of Example 26 except that the content of triazine was changed to 100 mmol per 1 mol of zirconium phthalocyanine.

Example 29

A photoconductor was prepared by the same way as that of Example 26 except that the content of triazine was changed to 100 mmol per 1 mol of zirconium phthalocyanine.

Example 30

A photoconductor was prepared by the same way as that of Example 26 except that the content of triazine was changed to 200 mmol per 1 mol of zirconium phthalocyanine.

Comparative Example 9

A photoconductor was prepared by the same way as that of Example 21 except that the content of triazine was changed to 50 nmol per 1 mol of zirconium phthalocyanine.

Comparative Example 10

A photoconductor was prepared by the same way as that of Example 21 except that the content of triazine was changed to 300 mmol per 1 mol of zirconium phthalocyanine.

Comparative Example 11

A photoconductor was prepared by the same way as that of Example 26 except that the content of triazine was changed to 50 nmol per 1 mol of zirconium phthalocyanine.

Comparative Example 12

A photoconductor was prepared by the same way as that of Example 26 except that the content of triazine was changed to 300 mmol per 1 mol of zirconium phthalocyanine.

The electrical characteristics of photoconductors were estimated by using an electrostatic recording paper testing device EPA-8100 manufactured by Kawaguchi Electric Works Co.,Ltd.

A surface of the photoconductor was charged by a corona discharge of a corotron system in darkness. In this case, a discharge voltage was regulated so as to charge the photoconductor's surface at a charged potential of −600 V. Then the corona discharge was switched off and the photoconductor was further placed in darkness for 5 seconds. During this period, the surface charge retention (%) was measured and listed in Table 3.

TABLE 3

| Examples (Ex.) or Comparative Examples (Com.) | Surface charge retention (%) |
|---|---|
| Ex. 21 | 96.1 |
| Ex. 22 | 95.3 |
| Ex. 23 | 95.4 |
| Ex. 24 | 96.1 |
| Ex. 25 | 95.8 |
| Ex. 26 | 95.4 |
| Ex. 27 | 95.8 |
| Ex. 28 | 95.2 |
| Ex. 29 | 96.3 |
| Ex. 30 | 96.5 |
| Com. 9 | 88.8 |
| Com. 10 | 89.4 |
| Com. 11 | 89.5 |
| Com. 12 | 88.3 |

As shown in Table 3, each of the photoconductors of Examples 21 to 30 shows excellent surface charge retention.

On the other hand, the surface charge retention of each of Comparative Examples 9 to 12 is lower than that of Examples.

Examples 31 to 40 and Comparative Examples 13 to 16

Example 31

A photoconductor was prepared by the same way as that of Example 21 except that vanadium phthalocyanine prepared by the conventional method was used instead of zirconium phthalocyanine of Example 21

Example 32

A photoconductor was prepared by the same way as that of Example 31 except that the content of triazine was changed to 10 μmol per 1 mol of vanadium phthalocyanine.

Example 33

A photoconductor was prepared by the same way as that of Example 31 except that the content of triazine was changed to 1 mmol per 1 mol of vanadium phthalocyanine.

Example 34

A photoconductor was prepared by the same way as that of Example 21 except that the content of triazine was changed to 100 mmol per 1 mol of vanadium phthalocyanine.

Example 35

A photoconductor was prepared by the same way as that of Example 31 except that the content of triazine was changed to 200 mmol per 1 mol of vanadium phthalocyanine.

Example 36

A photoconductor was prepared by the same way as that of Example 31 except that an acid pasting treatment using 96% sulfuric acid was performed after adding triazine, followed by washing in water and drying.

Example 37

A photoconductor was prepared by the same way as that of Example 36 except that the content of triazine was changed to 10 μmol per 1 mol of vanadium phthalocyanine.

Example 38

A photoconductor was prepared by the same way as that of Example 36 except that the content of triazine was changed to 1 mmol per 1 mol of vanadium phthalocyanine.

Example 39

A photoconductor was prepared by the same way as that of Example 36 except that the content of triazine was changed to 100 mmol per 1 mol of vanadium phthalocyanine.

Example 40

A photoconductor was prepared by the same way as that of Example 36 except that the content of triazine was changed to 200 mmol per 1 mol of vanadium phthalocyanine.

Comparative Example 13

A photoconductor was prepared by the same way as that of Example 31 except that the content of triazine was changed to 50 nmol per 1 mol of vanadium phthalocyanine.

Comparative Example 14

A photoconductor was prepared by the same way as that of Example 31 except that the content of triazine was changed to 300 mmol per 1 mol of vanadium phthalocyanine.

Comparative Example 15

A photoconductor was prepared by the same way as that of Example 36 except that the content of triazine was changed to 50 nmol per 1 mol of vanadium phthalocyanine.

Comparative Example 16

A photoconductor was prepared by the same way as that of Example 36 except that the content of triazine was changed to 300 mmol per 1 mol of vanadium phthalocyanine.

The electrical characteristics of photoconductors were estimated by using an electrostatic recording paper testing device EPA-8100 manufactured by Kawaguchi Electric Works Co., Ltd.

A surface of the photoconductor was charged by a corona discharge of a corotron system in darkness. In this case, a discharge voltage was regulated so as to charge the photoconductor's surface at a charged potential of −600 V. Then the corona discharge was switched off and the photoconductor was further placed in darkness for 5 seconds. During this period, the surface charge retention (%) was measured and listed in Table 4.

TABLE 4

| Examples (Ex.) or Comparative Examples (Com.) | Surface charge retention (%) |
|---|---|
| Ex. 31 | 96.3 |
| Ex. 32 | 95.2 |
| Ex. 33 | 95.9 |
| Ex. 34 | 95.8 |
| Ex. 35 | 95.6 |
| Ex. 36 | 95.2 |
| Ex. 37 | 95.4 |
| Ex. 38 | 94.9 |
| Ex. 39 | 95.9 |
| Ex. 40 | 96.0 |
| Com. 13 | 88.6 |
| Com. 14 | 89.1 |
| Com. 15 | 88.9 |
| Com. 16 | 87.8 |

As shown in Table 4, each of the photoconductors of Examples 31 to 40 shows excellent surface charge retention. On the other hand, the surface charge retention of each of Comparative Examples 13 to 16 is lower than that of Examples.

Examples 41 to 50 and Comparative Examples 17 to 20

Example 41

A photoconductor was prepared by the same way as that of Example 21 except that niobium phthalocyanine prepared by the conventional method was used instead of zirconium phthalocyanine of Example 21.

Example 42

A photoconductor was prepared by the same way as that of Example 41 except that the content of triazine was changed to 10 μmol per 1 mol of niobium phthalocyanine.

Example 43

A photoconductor was prepared by the same way as that of Example 41 except that the content of triazine was changed to 1 mmol per 1 mol of niobium phthalocyanine.

Example 44

A photoconductor was prepared by the same way as that of Example 41 except that the content of triazine was changed to 100 mmol per 1 mol of niobium phthalocyanine.

Example 45

A photoconductor was prepared by the same way as that of Example 41 except that the content of triazine was changed to 200 mmol per 1 mol of niobium phthalocyanine.

Example 46

A photoconductor was prepared by the same way as that of Example 41 except that an acid pasting treatment using 96% sulfuric acid was performed after adding triazine, followed by washing in water and drying.

Example 47

A photoconductor was prepared by the same way as that of Example 46 except that the content of triazine was changed to 10 μmol per 1 mol of niobium phthalocyanine.

Example 48

A photoconductor was prepared by the same way as that of Example 46 except that the content of triazine was changed to 1 mmol per 1 mol of niobium phthalocyanine.

Example 49

A photoconductor was prepared by the same way as that of Example 46 except that the content of triazine was changed to 100 mmol per 1 mol of niobium phthalocyanine.

Example 50

A photoconductor was prepared by the same way as that of Example 46 except that the content of triazine was changed to 200 mmol per 1 mol of niobium phthalocyanine.

Comparative Example 17

A photoconductor was prepared by the same way as that of Example 41 except that the content of triazine was changed to 50 nmol per 1 mol of niobium phthalocyanine.

Comparative Example 18

A photoconductor was prepared by the same way as that of Example 41 except that the content of triazine was changed to 300 mmol per 1 mol of niobium phthalocyanine.

Comparative Example 19

A photoconductor was prepared by the same way as that of Example 46 except that the content of triazine was changed to 50 nmol per 1 mol of niobium phthalocyanine.

Comparative Example 20

A photoconductor was prepared by the same way as that of Example 46 except that the content of triazine was changed to 300 mmol per 1 mol of niobium phthalocyanine.

The electrical characteristics of photoconductors were estimated by using an electrostatic recording paper testing device EPA-8100 manufactured by Kawaguchi Electric Works Co., Ltd.

A surface of the photoconductor was charged by a corona discharge of a corotron system in darkness. In this case, a discharge voltage was regulated so as to charge the photoconductor's surface at a charged potential of −600 V. Then the corona discharge was switched off and the photoconductor was further placed in darkness for 5 seconds. During this period, the surface charge retention (%) was measured and listed in Table 5.

TABLE 5

| Examples (Ex.) or Comparative Examples (Com.) | Surface charge retention (%) |
|---|---|
| Ex. 41 | 96.1 |
| Ex. 42 | 95.5 |
| Ex. 43 | 95.8 |
| Ex. 44 | 96.2 |
| Ex. 45 | 95.4 |
| Ex. 46 | 95.5 |
| Ex. 47 | 95.0 |
| Ex. 48 | 94.7 |
| Ex. 49 | 96.2 |
| Ex. 50 | 95.6 |
| Com. 17 | 88.1 |
| Com. 18 | 89.5 |
| Com. 19 | 88.7 |
| Com. 20 | 87.6 |

As shown in Table 5, each of the photoconductors of Examples 41 to 50 shows excellent surface charge retention. On the other hand, the surface charge retention of each of Comparative Examples 17 to 20 is lower than that of Examples.

Examples 51 to 60 and Comparative Examples 21 to 24

Example 51

A photoconductor was prepared by the same way as that of Example 21 except that gallium phthalocyanine prepared by the conventional method was used instead of zirconium phthalocyanine of Example 21.

Example 52

A photoconductor was prepared by the same way as that of Example 51 except that the content of triazine was changed to 10 μmol per 1 mol of gallium phthalocyanine.

Example 53

A photoconductor was prepared by the same way as that of Example 51 except that the content of triazine was changed to 1 mmol per 1 mol of gallium phthalocyanine.

Example 54

A photoconductor was prepared by the same way as that of Example 51 except that the content of triazine was changed to 100 mmol per 1 mol of gallium phthalocyanine.

Example 55

A photoconductor was prepared by the same way as that of Example 51 except that the content of triazine was changed to 200 mmol per 1 mol of gallium phthalocyanine.

Example 56

A photoconductor was prepared by the same way as that of Example 51 except that an acid pasting treatment using 96% sulfuric acid was performed after adding triazine, followed by washing in water, and drying.

Example 57

A photoconductor was prepared by the same way as that of Example 56 except that the content of triazine was changed to 10 μmol per 1 mol of gallium phthalocyanine.

Example 58

A photoconductor was prepared by the same way as that of Example 56 except that the content of triazine was changed to 1 mmol per 1 mol of gallium phthalocyanine.

Example 59

A photoconductor was prepared by the same way as that of Example 56 except that the content of triazine was changed to 100 mmol per 1 mol of gallium phthalocyanine.

Example 60

A photoconductor was prepared by the same way as that of Example 56 except that the content of triazine was changed to 200 mmol per 1 mol of gallium phthalocyanine.

Comparative Example 21

A photoconductor was prepared by the same way as that of Example 51 except that the content of triazine was changed to 50 nmol per 1 mol of gallium phthalocyanine.

Comparative Example 22

A photoconductor was prepared by the same way as that of Example 51 except that the content of triazine was changed to 300 mmol per 1 mol of gallium phthalocyanine.

Comparative Example 23

A photoconductor was prepared by the same way as that of Example 56 except that the content of triazine was changed to 50 nmol per 1 mol of gallium phthalocyanine.

Comparative Example 24

A photoconductor was prepared by the same way as that of Example 56 except that the content of triazine was changed to 300 mmol per 1 mol of gallium phthalocyanine.

The electrical characteristics of photoconductors were estimated by using an electrostatic recording paper testing device EPA-8100 manufactured by Kawaguchi Electric Works Co., Ltd.

A surface of the photoconductor was charged by a corona discharge of a corotron system in darkness. In this case, a discharge voltage was regulated so as to charge the photoconductor's surface at a charged potential V of −600 V. Then the corona discharge was switched off and the photoconductor was further placed in darkness for 5 seconds. During this period, the surface charge retention (%) was measured and listed in Table 6.

TABLE 6

| Examples (Ex.) or Comparative Examples (Com.) | Surface charge retention (%) |
|---|---|
| Ex. 51 | 96.3 |
| Ex. 52 | 95.9 |
| Ex. 53 | 95.6 |
| Ex. 54 | 95.8 |
| Ex. 55 | 95.6 |
| Ex. 56 | 95.6 |
| Ex. 57 | 94.9 |
| Ex. 58 | 94.6 |
| Ex. 59 | 96.0 |
| Ex. 60 | 95.5 |
| Com. 21 | 88.4 |
| Com. 22 | 89.6 |
| Com. 23 | 88.2 |
| Com. 24 | 87.4 |

As shown in Table 6, each of the photoconductors of Examples 51 to 60 shows excellent surface charge retention. On the other hand, the surface charge retention of each of Comparative Examples 21 to 24 is lower than that of Examples. Examples 61 to 70 and Comparative Examples 25 to 28

Example 61

A photoconductor was prepared by the same way as that of Example 21 except that indium phthalocyanine prepared by the conventional method was used instead of zirconium phthalocyanine of Example 21.

Example 62

A photoconductor was prepared by the same way as that of Example 61 except that the content of triazine was changed to 10 μmol per 1 mol of indium phthalocyanine.

Example 63

A photoconductor was prepared by the same way as that of Example 61 except that the content of triazine was changed to 1 mmol per 1 mol of indium phthalocyanine.

Example 64

A photoconductor was prepared by the same way as that of Example 61 except that the content of triazine was changed to 100 mmol per 1 mol of indium phthalocyanine.

Example 65

A photoconductor was prepared by the same way as that of Example 61 except that the content of triazine was changed to 200 mmol per 1 mol of indium phthalocyanine.

Example 66

A photoconductor was prepared by the same way as that of Example 61 except that an acid pasting treatment using 96% sulfuric acid was performed after adding triazine, followed by washing in water and drying.

Example 67

A photoconductor was prepared by the same way as that of Example 66 except that the content of triazine was changed to 10 μmol per 1 mol of indium phthalocyanine.

Example 68

A photoconductor was prepared by the same way as that of Example 66 except that the content of triazine was changed to 1 mmol per 1 mol of indium phthalocyanine.

Example 69

A photoconductor was prepared by the same way as that of Example 66 except that the content of triazine was changed to 100 mmol per 1 mol of indium phthalocyanine.

Example 70

A photoconductor was prepared by the same way as that of Example 66 except that the content of triazine was changed to 200 mmol per 1 mol of indium phthalocyanine.

Comparative Example 25

A photoconductor was prepared by the same way as that of Example 61 except that the content of triazine was changed to 50 nmol per 1 mol of indium phthalocyanine.

Comparative Example 26

A photoconductor was prepared by the same way as that of Example 61 except that the content of triazine was changed to 300 mmol per 1 mol of indium phthalocyanine.

Comparative Example 27

A photoconductor was prepared by the same way as that of Example 66 except that the content of triazine was changed to 50 nmol per 1 mol of indium phthalocyanine.

Comparative Example 28

A photoconductor was prepared by the same way as that of Example 66 except that the content of triazine was changed to 300 mmol per 1 mol of indium phthalocyanine.

The electrical characteristics of photoconductors were estimated by using an electrostatic recording paper testing device EPA-8100 manufactured by Kawaguchi Electric Works Co., Ltd.

A surface of the photoconductor was charged by a corona discharge of a corotron system in darkness. In this case, a discharge voltage was regulated so as to charge the photoconductor's surface at a charged potential of −600 V. Then the corona discharge was switched off and the photoconductor was further placed in darkness for 5 seconds. During this period, the surface charge retention (%) was measured and listed in Table 7.

TABLE 7

| Examples (Ex.) or Comparative Examples (Com.) | Surface charge retention (%) |
|---|---|
| Ex. 61 | 96.4 |
| Ex. 62 | 95.7 |
| Ex. 63 | 95.8 |
| Ex. 64 | 95.6 |
| Ex. 65 | 95.7 |
| Ex. 66 | 95.8 |
| Ex. 67 | 95.2 |
| Ex. 68 | 94.9 |
| Ex. 69 | 95.8 |
| Ex. 70 | 95.4 |
| Com. 25 | 89.3 |
| Com. 26 | 88.9 |
| Com. 27 | 87.9 |
| Com. 28 | 88.3 |

As shown in Table 7, each of the photoconductors of Examples 61 to 70 shows excellent surface charge retention. On the other hand, the surface charge retention of each of Comparative Examples 25 to 28 is lower than that of Examples.

Examples 71 to 80 and Comparative Examples 29 to 32

Example 71

A photoconductor was prepared by the same way as that of Example 21 except that germanium phthalocyanine prepared by the conventional method was used instead of zirconium phthalocyanine of Example 21.

Example 72

A photoconductor was prepared by the same way as that of Example 71 except that the content of triazine was changed to 10 μmol per 1 mol of germanium phthalocyanine.

Example 73

A photoconductor was prepared by the same way as that of Example 71 except that the content of triazine was changed to 1 mmol per 1 mol of germanium phthalocyanine.

Example 74

A photoconductor was prepared by the same way as that of Example 71 except that the content of triazine was changed to 100 mmol per 1 mol of germanium phthalocyanine.

Example 75

A photoconductor was prepared by the same way as that of Example 71 except that the content of triazine was changed to 200 mmol per 1 mol of germanium phthalocyanine.

Example 76

A photoconductor was prepared by the same way as that of Example 71 except that an acid pasting treatment using 96% sulfuric acid was performed after adding triazine, followed by washing in water and drying.

Example 77

A photoconductor was prepared by the same way as that of Example 76 except that the content of triazine was changed to 10 μmol per 1 mol of germanium phthalocyanine.

Example 78

A photoconductor was prepared by the same way as that of Example 76 except that the content of triazine was changed to 1 mmol per 1 mol of germanium phthalocyanine.

Example 79

A photoconductor was prepared by the same way as that of Example 76 except that the content of triazine was changed to 100 mmol per 1 mol of germanium phthalocyanine.

Example 80

A photoconductor was prepared by the same way as that of Example 76 except that the content of triazine was changed to 200 mmol per 1 mol of germanium phthalocyanine.

Comparative Example 29

A photoconductor was prepared by the same way as that of Example 71 except that the content of triazine was changed to 50 nmol per 1 mol of germanium phthalocyanine.

Comparative Example 30

A photoconductor was prepared by the same way as that of Example 71 except that the content of triazine was changed to 300 mmol per 1 mol of germanium phthalocyanine.

Comparative Example 31

A photoconductor was prepared by the same way as that of Example 76 except that the content of triazine was changed to 50 nmol per 1 mol of germanium phthalocyanine.

Comparative Example 32

A photoconductor was prepared by the same way as that of Example 76 except that the content of triazine was changed to 300 nmol per 1 mol of germanium phthalocyanine.

The electrical characteristics of photoconductors were estimated by using an electrostatic recording paper testing device EPA-8100 manufactured by Kawaguchi Electric Works Co., Ltd.

A surface of the photoconductor was charged by a corona discharge of a corotron system in darkness. In this case, a discharge voltage was regulated so as to charge the photoconductor's surface at a charged potential of −600 V. Then the corona discharge was switched off and the photoconductor was further placed in darkness for 5 seconds. During this period, the surface charge retention (%) was measured and listed in Table 8.

TABLE 8

| Examples (Ex.) or Comparative Examples (Com.) | Surface charge retention (%) |
|---|---|
| Ex. 71 | 95.7 |
| Ex. 72 | 96.1 |
| Ex. 73 | 95.7 |
| Ex. 74 | 95.1 |
| Ex. 75 | 96.2 |
| Ex. 76 | 95.7 |
| Ex. 77 | 95.5 |
| Ex. 78 | 94.9 |
| Ex. 79 | 95.4 |
| Ex. 80 | 95.6 |
| Com. 29 | 89.7 |
| Com. 30 | 89.2 |
| Com. 31 | 88.4 |
| Com. 32 | 87.9 |

As shown in Table 8, each of the photoconductors of Examples 71 to 80 shows excellent surface charge retention. On the other hand, the surface charge retention of each of Comparative Examples 29 to 32 is lower than that of Examples.

Examples 81 to 90 and Comparative Examples 33 to 36

Example 81

A photoconductor was prepared by the same way as that of Example 21 except that tin phthalocyanine prepared by the conventional method was used instead of zirconium phthalocyanine of Example 21.

Example 82

A photoconductor was prepared by the same way as that of Example 81 except that the content of triazine was changed to 10 $\mu$mol per 1 mol of tin phthalocyanine.

Example 83

A photoconductor was prepared by the same way as that of Example 81 except that the content of triazine was changed to 1 mmol per 1 mol of tin phthalocyanine.

Example 84

A photoconductor was prepared by the same way as that of Example 81 except that the content of triazine was changed to 100 mmol per 1 mol of tin phthalocyanine.

Example 85

A photoconductor was prepared by the same way as that of Example 81 except that the content of triazine was changed to 200 mmol per 1 mol of tin phthalocyanine.

Example 86

A photoconductor was prepared by the same way as that of Example 81 except that an acid pasting treatment using 96% sulfuric acid was performed after adding triazine, followed by washing in water and drying.

Example 87

A photoconductor was prepared by the same way as that of Example 86 except that the content of triazine was changed to 10 $\mu$mol per 1 mol of tin phthalocyanine.

Example 88

A photoconductor was prepared by the same way as that of Example 86 except that the content of triazine was changed to 1 mmol per 1 mol of tin phthalocyanine.

Example 89

A photoconductor was prepared by the same way as that of Example 86 except that the content of triazine was changed to 100 mmol per 1 mol of tin phthalocyanine.

Example 90

A photoconductor was prepared by the same way as that of Example 86 except that the content of triazine was changed to 200 mmol per 1 mol of tin phthalocyanine.

Comparative Example 33

A photoconductor was prepared by the same way as that of Example 81 except that the content of triazine was changed to 50 nmol per 1 mol of tin phthalocyanine.

Comparative Example 34

A photoconductor was prepared by the same way as that of Example 81 except that the content of triazine was changed to 300 mmol per 1 mol of tin phthalocyanine.

Comparative Example 35

A photoconductor was prepared by the same way as that of Example 86 except that the content of triazine was changed to 50 nmol per 1 mol of tin phthalocyanine.

Comparative Example 36

A photoconductor was prepared by the same way as that of Example 86 except that the content of triazine was changed to 300 mmol per 1 mol of tin phthalocyanine.

The electrical characteristics of photoconductors were estimated by using an electrostatic recording paper testing device EPA-8100 manufactured by Kawaguchi Electric Works Co., Ltd.

A surface of the photoconductor was charged by a corona discharge of a corotron system in darkness. In this case, a discharge voltage was regulated so as to charge the photoconductor's surface at a charged potential of −600 V. Then the corona discharge was switched off and the photoconductor was further placed in darkness for 5 seconds. During this period, the surface charge retention (%) was measured and listed in Table 9.

TABLE 9

| Examples (Ex.) or Comparative Examples (Com.) | Surface charge retention (%) |
|---|---|
| Ex. 81 | 96.4 |
| Ex. 82 | 96.0 |
| Ex. 83 | 95.5 |
| Ex. 84 | 95.6 |
| Ex. 85 | 96.2 |
| Ex. 86 | 96.1 |
| Ex. 87 | 95.8 |
| Ex. 88 | 95.5 |
| Ex. 89 | 95.7 |
| Ex. 90 | 95.4 |
| Com. 33 | 88.1 |
| Com. 34 | 88.3 |
| Com. 35 | 88.7 |
| Com. 36 | 89.1 |

As shown in Table 9, each of the photoconductors of Examples 81 to 90 shows excellent surface charge retention. On the other hand, the surface charge retention of each of Comparative Examples 33 to 36 is lower than that of Examples.

As is evident from the examples described above, an electrophotographic photoconductor having an excellent surface-charge retention can be obtained when the content of phthalonitrile polymer is in the range of 100 nmol to 200 mmol with respect to 1 mol of phthalocyanine compound in a photosensitive layer. It is noted that the photosensitive layer may be of the type of single layered structure or of the type of laminated structure, but not limited to either of these types.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An electrophotographic photoconductor comprising a conductive substrate and a photosensitive layer, in which said photosensigtive layer is laminated on said conductive substrate and includes at least phthalocyanine compound as a photoconductive material, wherein said photosensitive layer contains o-phthalonitrile polymer, except said phthalocyanine compound, in a range of 100 nmol to 200 mmol with respect to 1 mol of said phthalocyanine compound.

2. An electrophotographic photoconductor as claimed in claim 1, wherein said phthalocyanine compound is non-metallic phthalocyanine, preferably x-type non-metallic phthalocyanine.

3. An electrophotographic photoconductor as claimed in claim 1, wherein said phthalocyanine compound is titanyl oxyphthalocyanine, preferably a mixture of said titanyl oxyphthalocyanine and said o-phthalonitrile polymer except said titanyl oxyphthalocyanine having a clear peak of diffraction intensity observed at Bragg angle (2θ) of at least 27.3°±0.2° in an X-ray diffraction spectrum obtained by performing an X-ray diffraction method.

4. An electrophotographic photoconductor as claimed in claim 1, wherein said phthalocyanine compound is titanyl oxyphthalocyanine, preferably a mixture of said titanyl oxyphthalocyanine and said o-phthalonitrile polymer except said titanyl oxyphthalocyanine having a maximum diffraction intensity observed at Bragg angle (2θ±0.2°) of 9.6° and clear peaks of diffraction intensity observed at 7.2°, 9.6°, 11.6°, 13.4°, 14.9°, 18.3°, 23.6°, 24.1°, and 27.3°, respectively, in an X-ray diffraction spectrum.

5. An electrophotographic photoconductor as claimed in claim 1, wherein a center metal of said phthalocyanine compound is selected from a group of zirconium, vanadium, niobium, gallium, indium, germanium, and tin.

6. An electrophotographic photoconductor as claimed in claim 1, wherein an under coat layer is provided between said conductive substrate and said photosensitive layer.

7. An electrophotographic photoconductor as claimed in claim 1, wherein said photosensitive layer comprises a charge generation layer and a charge transport layer laminated on said charge generation layer, and said phthalocyanine compound is included in said charge generation layer.

* * * * *